United States Patent [19]

Jones et al.

[11] 4,333,261

[45] Jun. 8, 1982

[54] TWO SPEED TOY CAR AND TRACK ASSEMBLY

[75] Inventors: Lawrence T. Jones, Playa Del Rey; Anson Sims, Granada Hills; Ashley G. Howden; Mark S. Knighton, both of Los Angeles; L. C. James Kingsbury, Fountain Valley; Richard F. M. Conroy, Woodland Hills, all of Calif.

[73] Assignee: California R & D Center, Culver City, Calif.

[21] Appl. No.: 114,198

[22] Filed: Jan. 22, 1980

[51] Int. Cl.[3] ..... A63H 17/36

[52] U.S. Cl. ..... 46/257; 46/262; 273/86 B

[58] Field of Search ..... 46/257, 262, 251, 252, 46/253, 254, 255, 256, 258, 259, 260, 261, 248; 273/86 B

[56] References Cited

U.S. PATENT DOCUMENTS

| | | | |
|---|---|---|---|
| 2,786,680 | 3/1957 | Northrop et al. | 46/257 |
| 3,883,985 | 5/1975 | Dawson, Jr. | 46/60 |
| 4,223,476 | 9/1980 | Meyer et al. | 46/257 |
| 4,231,183 | 11/1980 | Lahr | 46/262 |
| 4,248,012 | 2/1981 | Kirby et al. | 46/253 |

FOREIGN PATENT DOCUMENTS

| | | | |
|---|---|---|---|
| 2809250 | 9/1978 | Fed. Rep. of Germany | 46/262 |
| 2851550 | 6/1979 | Fed. Rep. of Germany | 46/262 |

*Primary Examiner*—Gene Mancene
*Assistant Examiner*—Michael J. Foycik
*Attorney, Agent, or Firm*—Jackson, Jones & Price

[57] ABSTRACT

A toy car adapted to travel on a track assembly is disclosed. The toy car includes a motor coupled to a drive train which drives the car forwards regardless of a direction of rotation of an output shaft of the motor. The drive train includes a first set of gears ooupled with a first one-way clutch to drive an axle of the car when the output shaft of the motor rotates in a first direction. The drive train also includes a second set of gears coupled with a second one-way clutch to drive the axle when the output shaft rotates in a second direction. The first set of gears represent a higher gear reduction ratio from the output shaft to the axle than the second set of gears whereby a speed of the forward motion of the car may be altered by reversing the direction of rotation of the motor. The motor of the car draws electric power from the track assembly. A suitable switch and an electric circuitry are operatively associated with the track assembly to reverse polarity of direct current supplied to the track whereby the direction of rotation of the motor is reversed.

18 Claims, 7 Drawing Figures

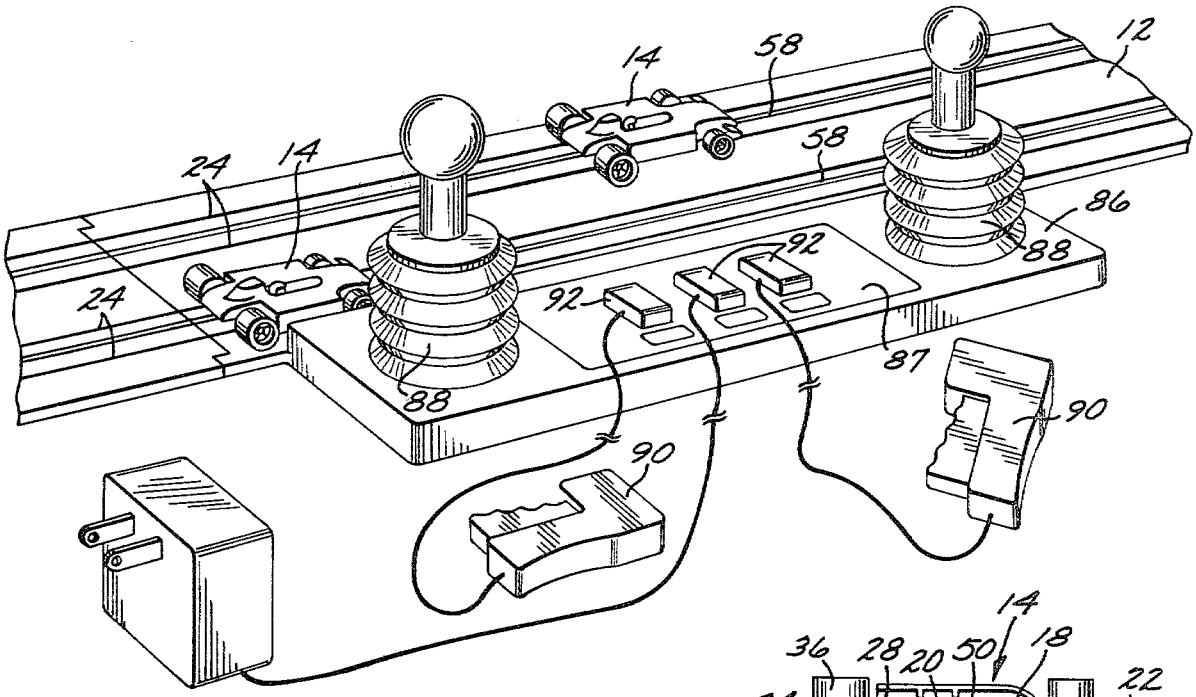
FIG. 1
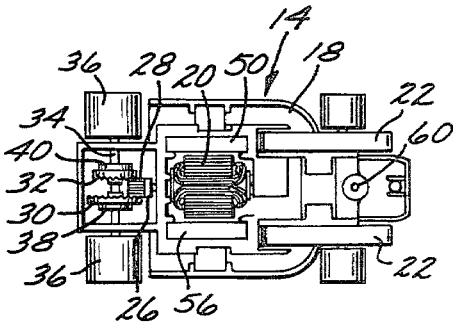
FIG. 3
FIG. 2
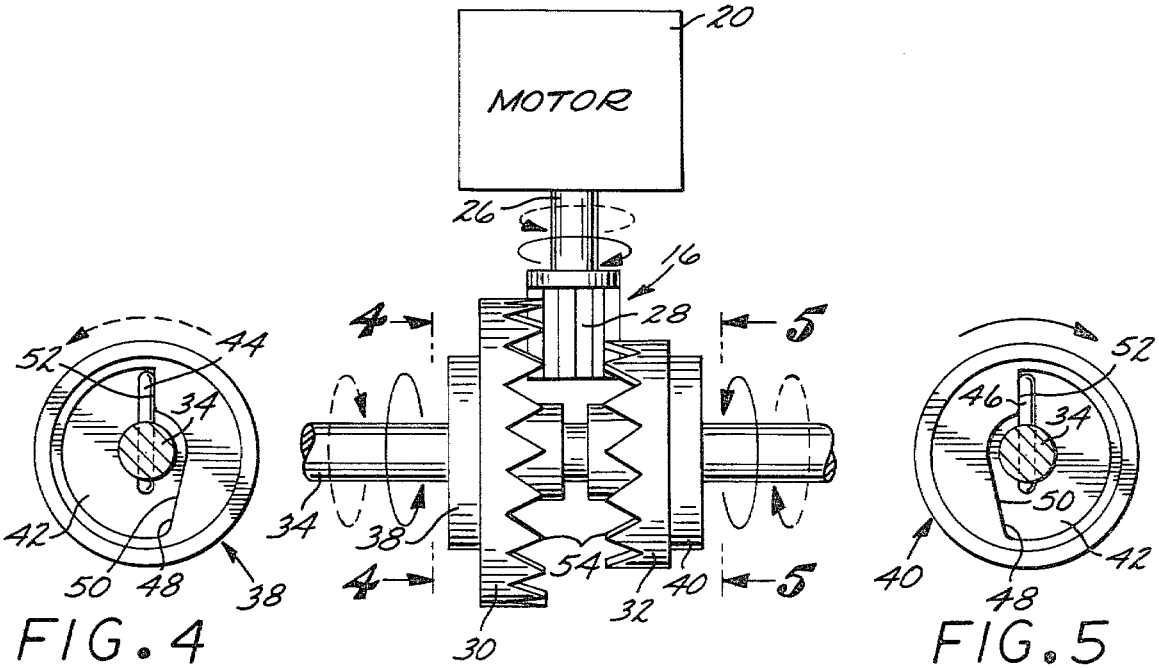
FIG. 4
FIG. 5

TWO SPEED TOY CAR AND TRACK ASSEMBLY

BACKGROUND OF THE INVENTION

1. Field of the Invention

The present invention relates to a two-speed toy car and track assembly and more particularly to a two-speed toy car and track assembly wherein the speed of a toy car travelling on a track is changed by reversing the polarity of direct current supplied to a motor incorporated in the car.

2. Brief Description of the Prior Art

The prior art is well aware of toy cars adapted for travelling on a predetermined track. More particularly, the prior art is well aware of toy cars which incorporate an electric motor receiving a supply of current from a track assembly. Toy cars described in U.S. Pat. Nos. 4,163,341 and 4,136,485 generally reflect the current state of the art relating to electric powered toy cars adapted for travelling on a track.

As is well appreciated by those skilled in the art, a toy car travelling on a track, particularly one which is used for simulated racing and which is expected to negotiate sharp turns at relatively high speeds, must have significant traction relative to the surface of the track. Means employed in the prior art for providing relatively high traction include the use of wide, high friction driving wheels, increasing the weight of the car, and providing a magnetic force which attracts the car to the track surface.

The relatively large traction of the toy car to the surface of the track, such as the one which may be achieved by the aforesaid magnetic attracting force, however, creates a difficulty in controlling the speed of the toy car. More particularly, prior art toy car track assemblies typically utilize a continuously variable resistive load placed in the path of the current supplied to the car as a means for controlling the speed of the car at the option of a player. However, when the traction between the track surface and the car is relatively large, it is difficult and therefore economically undesirable to provide an electric motor which is capable of responding to an electric power input varying across a wide range. It is especially difficult and therefore economically undesirable to provide an electric motor for a toy car which is capable of propelling the toy car on a high traction surface without stalling when the applied voltage is deliberately set at a low value.

Accordingly, the present invention is directed to a toy car and track assembly combination wherein the car has good traction on the track surface and wherein the speed of the car may be controlled by changing a gear reduction ratio in the drive train of the car.

The car track assembly combination of the present invention is hereinafter described in detail. For the purpose of describing the background of the present invention, it is however deemed necessary to describe briefly a prior art toy car which in its construction bears some resemblance to the toy car of the present invention.

Thus, a toy car which has been commercially available in the United States includes a steering mechanism which is responsive to a change in the polarity of the direct current supplied to the car by a pair of electrically conducting rails incorporated in a track. In order to avoid reversal of direction of travel of the car each time the polarity of the current in the rails is changed, a pinion gear mounted to an output shaft of the motor of the car is connected to two crown gears. The crown gears are driven by the pinion gear to rotate in opposite direction relative to one another, and each crown gear is provided with a one-way clutch. The one-way clutches are operatively connected with an axle of two driven rear wheels of the toy car. Each one-way clutch is designed to engage and drive the axle only when the respective crown gear rotates in a direction which, when transferred to the axle, would result in a forward motion of the vehicle. In other words, as the output shaft of the electric motor rotates in a first direction, only the first crown gear engages the axle and drives the vehicle forward. When rotation of the output shaft of the motor is reversed, the second crown gear engages the axle and still drives the car forward. In this manner a reversal of the polarity of the current supplied to the motor in the course of steering the car has no net effect on the rear driving wheels of the car.

In contrast to the above described prior art toy car, the toy car of the present invention utilizes changes in the polarity of the current supplied to the electric motor of the car to affect a change in the speed of travel of the car.

SUMMARY OF THE INVENTION

It is an object of the present invention to provide a toy car wherein the speed of the car is changed by changing a direction of rotation of a motor mounted in the car.

It is another object of the present invention to provide a toy car and track assembly combination wherein the speed of the car is changed at the option of a player by moving a simulated gear stick shift which changes the polarity of current supplied through the track assembly to the car.

It is still another object of the present invention to provide a toy car and track assembly combination wherein a speed of the toy car may be varied continuously and also by increments, the car having good performance and traction characteristics at all operating speeds.

These and other objects and advantages are attained by a toy car which includes a motor mounted into a chassis body. The motor has an output shaft capable of rotating in a first and a second direction. A first set of gears and a second set of gears are driven by the rotating output shaft. Each set of gears is respectively coupled to a first and a second one-way clutch. The first and second sets of gears are disposed to rotate in opposite directions relative to one another. Each one-way clutch is operatively connected to an axle which interconnects two driven wheels of the toy car. The first one-way clutch is adapted to drive the axle only when the output shaft of the motor rotates in the first direction, and the second one-way clutch is adapted to drive the axle only when the output shaft rotates in the second direction. The first set of gears has a higher gear reduction ratio relative to the output shaft of the motor than the second gear whereby a speed of the toy car becomes dependent on the direction of rotation of the motor.

The toy car may be adapted for travelling on a predetermined track wherein a pair of electrically conductive rails supply direct current to the motor of the car. A switch is configured to simulate a gear stick shift and associated electric circuitry is adapted for switching polarity of the current supplied to the rails. A continuously variable resistive load may be incorporated in the path of the electric current supplied to the rails whereby the speed of the car may also be varied continuously.

The objects and features of the present invention are set forth in the appended claims. The present invention may be best understood by reference to the following description, taken in connection with the accompanying drawings in which like numerals indicate like parts.

BRIEF DESCRIPTION OF THE DRAWINGS

FIG. 1 is a perspective view of the preferred embodiment of the toy car track assembly combination of the present invention, the track assembly being shown only in part;

FIG. 2 is a bottom view of the preferred embodiment of the toy car of the present invention;

FIG. 3 is a partial, schematic top plan view of a drive train of the preferred embodiment of the toy car of the present invention;

FIG. 4 is a view of a first one-way clutch mechanism incorporated in the drive train of the preferred embodiment of the toy car of the present invention, the view being taken at lines 4—4 of FIG. 3;

FIG. 5 is a view of a second one-way clutch mechanism incorporated in the drive train of the preferred embodiment of the toy car of the present invention, the view being taken on lines 5—5 of FIG. 3;

DESCRIPTION OF THE PREFERRED EMBODIMENT

Figure 6:
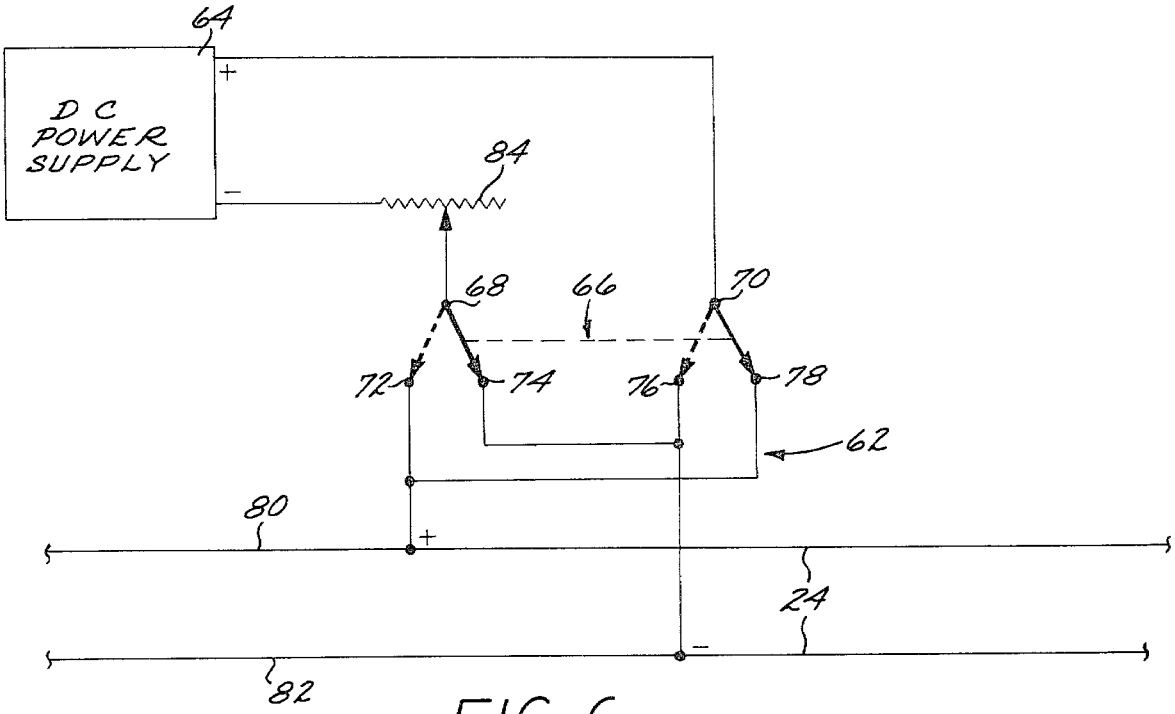
FIG. 6 is a diagrammatic representation of an electric circuit and switch adapted for use in the toy car track assembly combination of the present invention.

The following specification taken in conjunction with the drawings sets forth the preferred embodiment of the present invention in such a manner that any person skilled in the toy manufacturing and electrical arts can use the invention. The embodiments of the invention disclosed herein are the best modes contemplated by the inventors for carrying out their invention in a commercial environment, although it should be understood that various modifications can be accomplished within the scope of the present invention.

Referring now to the drawing Figures and particularly to the perspective view of FIG. 1, a preferred embodiment of the toy car and track assembly combination of the present invention is disclosed. The combination includes a track assembly 12 which determines a path of travel for the toy car 14. In this regard, it is noted that a single toy car 14 or a plurality of toy cars 14 adapted to travel on the track assembly 12 may be provided within the scope of the present invention. As is shown on FIG. 1, the herein described preferred embodiment of the toy racing car and track assembly combination incorporates two identical toy cars 14, with the track assembly 12 providing a predetermined path of travel for both of the cars 14.

Referring now to FIGS. 2, 3, 4 and 5, the structure of the toy car 14 and particularly its unique drive train 16 is described in detail. The toy car 14 includes a chassis body 18 and a motor 20 such as a direct current powered electric motor mounted within the chassis body 18. Accordingly, the toy car 14 includes suitable spring loaded pick-up shoes 22 which are adapted to stay in contact with electrically conductive rails 24 provided in the track assembly 12. The pick-up shoes may be constructed in accordance with U.S. Pat. Nos. 4,163,341 and 4,136,485, the specifications of which are hereby expressly incorporated by reference.

The motor 20 includes an output shaft 26 which may rotate in a first and in a second direction as respectively shown by the dotted and solid arrows on the schematic view of FIG. 3. As is well appreciated by those skilled in the art, the direction of the rotation of the output shaft 26 of the electric motor 20 depends on the polarity of the direct current supplied to the motor 20.

The output shaft 26 of the motor includes a pinion gear 28 which drives a first crown gear 30 and a second crown gear 32, best shown on FIG. 3. The first and second crown gears 30 and 32 are rotatably mounted relative to an axle 34 which is disposed perpendicularly to an axis of rotation of the pinion gear 28. In the preferred embodiment of the toy car 14 of the present invention, the axle 34 comprises a rear axle of the toy car 14 and therefore bears two rear wheels 36 of the car 14. The rear wheels 36 which comprise the driving wheels of the car 14 are not shown on the schematic view of FIG. 3. The rear wheels 36 are connected to the axle 34 to rotate in unison therewith.

A one-way clutch is incorporated in each crown gear 30 and 32. The one-way clutches are shown on FIGS. 4 and 5 and respectively bear the reference numerals 38 and 40.

As it was stated above and is readily apparent from an inspection of FIG. 3, the first and second crown gears 30 and 32 both rotate when the electric motor 20 is energized and the pinion gear 28 is accordingly set in rotation. Because of the positioning of the crown gears 30 and 32 on opposite lateral sides of the pinion gear 28, the crown gears 30 and 32 always rotate in a direction opposite to one another. On FIG. 3, rotation of the several elements of the toy 14 when the output shaft rotates in a first, counterclockwise direction is indicated by dotted arrows. Conversely, rotation of the several elements when the output shaft 26 is rotated in a second, clockwise direction is indicated by solid arrows.

The purpose of the first and second one-way clutches is to transmit a driving force to the axle 34 and to the rear wheels 36 to drive the toy car 14 in a forwardly direction regardless of the direction of the rotation of the output shaft 26. In order to accomplish this, the crown gears 30 and 32 are mounted to the axle 34 so as to rotate independently of the axle 34. Each crown gear 30 and 32 has an indentation or cavity 42 incorporated in its exterior side. Pins 44 and 46, respectively shown on FIGS. 4 and 5, are respectively accommodated in the cavity 42 of each crown gear 30 and 32. The pins 44 and 46 are transversely and slideably mounted into the axle 34 so that each pin is free to slide relative to the axle 34 to an extent permitted by an interior surface 48 of each cavity 42 of the respective crown gear 30 or 32. The interior surface 48 includes a camming surface 50 and also incorporates a sharp discontinuity 52 in the camming surface 50. As a result of this particular arrangement, in one direction of rotation of each crown gear 30 and 32 the respective pin 44 or 46 is engaged by the discontinuity 52 and the axle 34 is driven by the crown gear. Conversely in another, opposite direction of rotation of the crown gear 30 or 32, the respective pin 44 or 46 is continuously cammed by the camming surface 50 to transversely slide in the axle 34. In this case the respective crown gear 30 or 32 rotates independently of the axle 34. The arrows on FIGS. 4 and 5 show that direction of rotation of each crown gear 30 and 32 in which the axle 34 is actually driven by the respective crown gear. The above described one-way clutch mechanism is commonly referred to in the art as a snail type clutch. In alternative embodiments of the present invention, the toy car 14 may incorporate one-way clutch mechanisms of different construction, the exact structure of the same not being critical for the purpose of practicing the present invention.

Still referring principally to FIG. 3, sizing of the crown gears 30 and 32 relative to one another is shown. The first crown gear 30 has more teeth 54 than the second crown gear 32. Therefore, the first and second crown gears 30 and 32 are not driven at equal speed by the rotating output shaft 36. In the herein described preferred embodiment of the toy car 14, the pinion gear 28 has seven teeth, the first crown gear 30 has twenty-one teeth, and the second crown gear 32 has fourteen teeth. Accordingly, the first crown gear 30 represents a reduction ratio of $33\frac{1}{3}\%$ from the rotating output shaft 36 to the wheels 36 while the second crown gear 32 represents a reduction of 50%.

In order to provide significant traction to the toy car 14, a magnet 56 is located in the car 14 to interface with the rails 24. The rails 24 are made of a ferromagnetic material such as steel so that a significant magnetic attractive force occurs between the toy car 14 and the rails 24 when the toy car 14 is operatively positioned on the track assembly 12. The magnet 56 conveniently also comprises the magnetic armature of the electric motor 20. A slot 58, shown on FIG. 1, is disposed in the track assembly 12 between the two rails 24 provided for each car 14. A pin 60 mounted to the bottom of each car 14 engages the respective slot 60 to securely guide the car 14 on the track even at a relatively high speed. An overall result of the above described magnetic attractive force between the car 14 and the rails 24 of the track assembly 12 and of the guide slot pin combination is that the car 14 very securely follows the track assembly 12 and is able to negotiate sharp turns at relatively high speeds.

Referring now to FIG. 6, an electric circuit 62 adapted for switching polarity of the rail 24 which energizes any one of the two cars 14 on the track assembly 12 is shown. The electric circuit 62 includes a direct current power supply 64 which may be a suitable array of batteries. Alternatively, the power supply 64 may be a transformer-rectifier combination which converts household AC current to a low voltage DC current. The power supply 64 utilized in the preferred embodiment of the present invention and shown on FIG. 1 is such a transformer rectifier combination and has an output of approximately 12 volts DC.

The electric circuit 62 includes a "double-pole double throw-switch" 66 which is well known in the art and is readily available commercially. Accordingly, the switch 66 is described here only to the extent deemed necessary for understanding the present invention.

Briefly, the switch 66 includes six contact points respectively designated 68, 70, 72, 74, 76 and 78 and two positions wherein voltage is applied to the rails 24. The negative and positive poles of the power supply 64 are respectively connected to points 68 and 70. Point 72 is permanently wired to point 78 and point 74 is permanently wired to point 76. Point 72 is connected to a first rail 80 of the rail pair 24 and point 76 is permanently connected to a second rail 82 of the rail pair 24. In a first position of the switch 66, indicated on FIG. 6 by solid lines, point 68 is connected with point 74 and point 70 is connected with point 78. As is apparent from an inspection of FIG. 6, in the first position of the switch 66 the first rail 80 receives a positive voltage, and the second rail 82 receives a negative voltage.

In a second position of the switch 66, shown by dotted lines on FIG. 6, point 68 is connected to point 72 and point 70 is connected to point 76. In this second position, the rail 80 receives a negative voltage and the rail 82 receives a positive voltage. Thus, a change in the positioning of the switch 66 results in a reversal of the polarity of the DC voltage applied to the rails 80 and 82. This results in a change of the rotation of the output shaft 26 of the motor 20 of the car 14 which is riding on the rails 80 and 82. As it was described above, the net effect of reversing the rotation of the output shaft 26 is a change in the speed of the car 14.

A continuously variable resistive load 84 in the form of a potentiometer may be connected between one of the poles of the power supply 64 and the switch 66. Changing the resistive load 84 results in a change of the speed of the car 14. This is, of course, in addition to a change in speed brought about by a change in the polarity of the voltage applied to the rails 80 and 82.

Referring now again to FIG. 1, the preferred embodiment of the toy car track assembly combination of the present invention is explained further. In the preferred embodiment, two switches are physically attached to a segment 86 of the track assembly 12 which incorporates a control panel 87. These switches are configured in the shape of a gear stick shift 88. Each stick shift 88 is wired to control one of the toy cars 14 which travel on the track assembly. A continuously variable resistive load whereby speed of each car 14 may be continuously controlled is attached to the control panel 87. These are shaped in the form of a hand holdable pistol type grip 90. The control panel 87 additionally includes several lights 92 which may include an on-and-off light for the entire toy assembly, and on-and-off lights for the individual cars. The switches configured in the shape of the stick shifts 88 and the attendant circuitry may be of the type shown on FIG. 6.

The preferred embodiment of the toy car track assembly combination of the present invention, however, incorporates a circuitry which is different from the circuitry shown on FIG. 6. This circuitry is hereinafter described with particular reference to FIG. 7.

Practical experience in connection with the toy car track assembly combination of the present invention demonstrated that when a relatively inexpensive electric motor 20 is used in the toy car 14, the effect of reversing the polarity of the voltage applied to the rails 24 in order to bring about a change in speed of the toy car 14 is somewhat negated by an attendant change in the loading of the motor 20. More precisely stated, as the polarity of the voltage applied to the motor 20 is changed and the unique drive train 16 of the car 14 shifts into a lower gear, the load on the motor 20 decreases. Unless the motor 20 is designed to run at a substantially constant speed regardless of loading, the motor 20 speeds up to a certain extent due to the decrease in loading. This speeding up tendency of the motor 20 somewhat diminishes the "slowing down" effect of the unique drive train 16 of the present invention.

In the event the circuitry 62 shown on FIG. 6 is incorporated in the toy car track assembly combination, a child (not shown) playing with the toy may coordinate a change in the setting of the variable resistive load 84 with a "shifting of gears" in order to boost the desired slowing down effect. In the preferred embodiment of the toy car assembly combination of the present invention, however, an electric circuit 94 and switch 96 combination is provided to electrically boost the mechanical "slowing down" effect of the unique drive train 16. This permits construction of the toy car 14 with relatively inexpensive and commercially readily available electric motors and permits very reliable operation of the toy without calling for particularly great exercise of skill by a child player.

Figure 7:
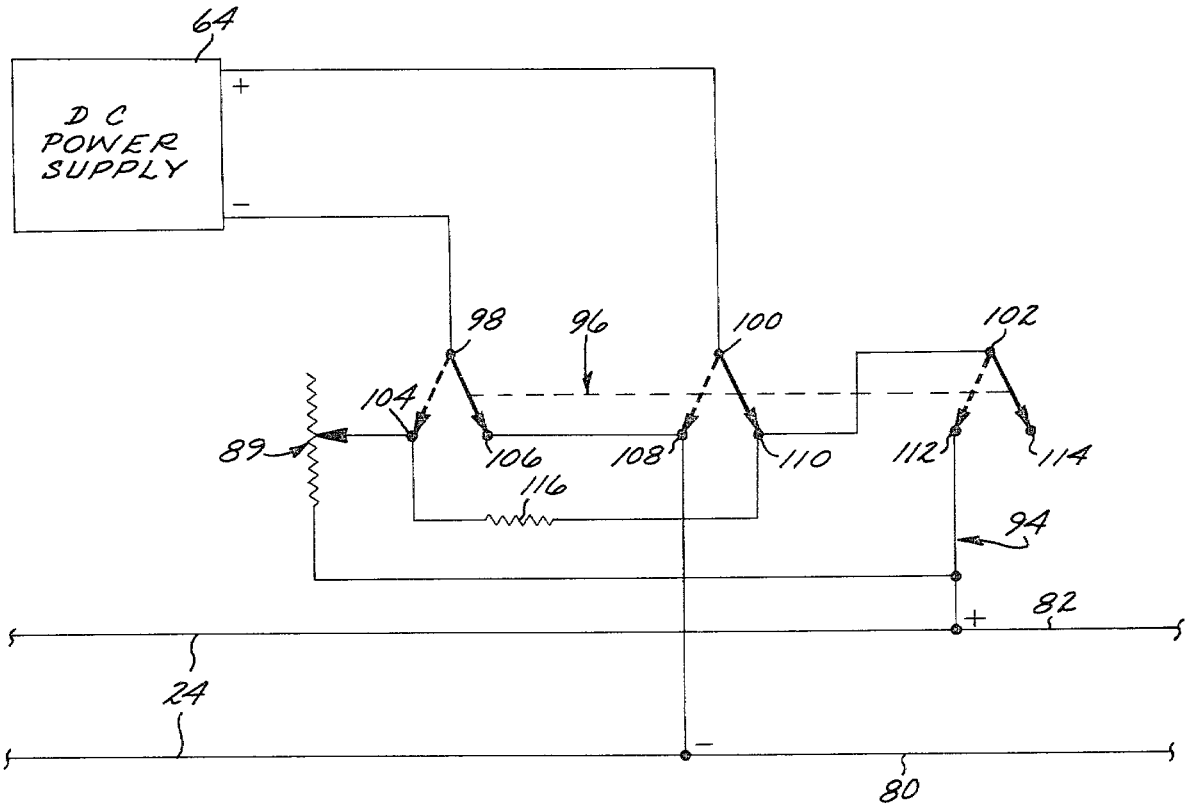
FIG. 7 is a diagrammatic representation of an electric circuit and switch used in the first preferred embodiment of the toy car and track assembly combination of the present invention.

Referring now to FIG. 7, the circuit 94 and switch 96 combination which is actually used in the preferred embodiment of the present invention is explained. The switch 96 is a "triple pole double throw" switch which is well known in the art and is readily available commercially. The switch 96 has nine contact points respectively bearing the reference numerals 98, 100, 102, 104, 106, 108, 110, 112 and 114. The negative and the positive poles of the power supply 64 are respectively connected to points 98 and 100. Points 108 and 112 are respectively connected to the first and second rails 80 and 82 of the rail pair 24. Point 104 is also connected with point 112 through a continuously variable resistive load 84. A resistive load 116 of a predetermined magnitude is placed between points 104 and 110. In the herein described preferred embodiment of the toy car track assembly combination the continuously variable resistive load 84 is variable between approximately zero to 45 Ω. Each gear stick shift 88, shown on FIG. 1 incorporates the triple pole double throw switch 96, and each pistol grip 90 incorporates the variable resistive load or potentiometer 84.

Still referring to FIG. 7, connection of point 106 with 108 and of point 110 with 102 is shown. In a first position of the switch 96, shown by solid lines on FIG. 7, positive voltage is applied to the rail 82 through the predetermined resistive load 116 and through the continuously variable resistive load 84. These two resistive loads 84 and 116 are thus connected in series. On the other hand, negative voltage is applied to the rail 80 through points 98 and 108. The hereinbefore described first position of the switch 96 corresponds to polarization of the motor 20 in such a manner that the car 14 is driven through the first crown gear 30, i.e. the car is shifted into a "low gear". Thus, when the car 14 is run in low gear, a 15 Ω resistive load is automatically applied so as to counter-balance any tendency of the motor 20 to gain speed because of a low loading. A player (not shown) is of course able to further regulate speed of the car 14 by adjustment of the variable resistive load 84.

In a second position of the switch 96, shown by dotted lines on FIG. 7, positive voltage is applied to rail 80 through points 100 and 108. Negative voltage is applied to rail 82 through points 98, 104 and through the continuously variable resistive load 84. Negative voltage is also applied to the rail 82 from point 104 through the predetermined resistive load 116 and through points 110, 102 and 112. Thus, in the second position of the switch 96 the resistive loads 84 and 116 are connected parallel with one another and the polarity of the rails 80 and 82 is reversed as compared to the first position of the switch 96. The net effect of the parallel connected resistive loads 84 and 116 is that the actual resistance placed in the circuit 94 varies between approximately zero Ω to a maximum of approximately 11.25 Ω depending on the setting of the variable resistive load 84 by the player (not shown). The hereinbefore described second position of the switch 96 corresponds to polarization of the motor 20 wherein the car 14 is driven through the second crown gear 32, i.e. when the car 14 is in "high gear." Thus, the unique drive train 16 and the circuit 94 cooperate to place the car 14 into a "high gear" or a "low gear" mode of travel at the option of the player (not shown).

It should be readily apparent from the above description that two players (not shown) may simultaneously play with the toy car track assembly combination of the present invention. During play, each player controls one car 14 through the corresponding gear stick shift 88 and the pistol grip 90. The stick shift 88 regulates the speed of the car 14 in an increment in realistic simulation of the stick shift of a real automobile. The pistol grip 90, on the other hand, permits continuous variation of the speed of the car 14 in realistic simulation of a throttle of a real automobile. By playing with the toy, a child (not shown) may acquire certain coordination and understanding of the function of a "throttle" and "stick shift", in a real automobile. The ability of the toy car 14 to negotiate turns at a relatively high speed on the track assembly 12 further contributes to the play value of the toy car track assembly combination of the present invention.

Several modifications of the hereinbefore described toy car track assembly combination may become apparent to those skilled in the art in light of the above disclosure. Accordingly, the scope of the present invention should be interpreted solely from the following claims.

What is claimed is:

1. A miniature toy car having different forward driving gear ratios to provide at least two different forward speeds to the car comprising:

a car chassis body;

a reversible electric motor mounted to the car chassis body and having a rotating output shaft;

wheel means connected to the chassis body to permit movement of the toy car on a support surface, the wheel means including a pair of driving wheels interconnected by a rigid axle;

a first set of gears operatively connected to the output shaft of the motor and driven thereby;

a one-way clutch connecting the first set of gears to the axle to drive the axle and the driving wheels in a forwardly direction only as the output shaft is rotated in a first direction, the one-way clutch allowing the first set of gears to rotate independently of the rigid axle when the output shaft rotates in a second direction;

a second set of gears operatively connected to the output shaft of the motor and driven thereby, and a second one-way clutch connecting the second set of gears to the axle to drive the axle and the driving wheels in a forwardly direction only as the output shaft is rotated in the second direction which is opposite to the first direction, the second one-way clutch allowing the first set of gears to rotate independently of the rigid axle when the output shaft rotates in the first direction, the first and second sets of gears having different gear ratios for driving the axle whereby the speed of forwardly driven rotation of the entire axle and of both rear wheels depends on the direction of rotation of the output shaft of the reversible electric motor.

2. The invention of claim 1 wherein the output shaft of the motor has a pinion gear, and wherein the first and second sets of gears each include a crown gear engaging the pinion gear on opposite sides thereof whereby in any given direction of rotation of the output shaft the respective crown gears rotate in a direction opposite to one another, the respective crown gears together with the pinion gear respectively comprising the first and the second sets of gears.

3. The invention of claim 2 wherein each crown gear is pivotably mounted upon the axle, and wherein the first and second one way clutch each comprises a pin transversely and slideably mounted into the axle and cam means incorporated in each crown gear, the cam means being adapted for engaging the pin as the respective crown gear is rotated in a first direction and thereby driving the axle and for disengaging the pin as the respective crown gear is rotated in a second direction, the second direction being opposite to the first direction.

4. The invention of claim 1 wherein the motor is a direct current electric motor whereby rotational direction of the motor is altered as the polarity of a direct current power supply energizing the motor is reversed.

5. The invention of claim 1 wherein the toy car is adapted for travelling on a track, the track having a pair of conductive rails supplying direct current to the motor of the car.

6. The invention of claim 1 wherein the driving wheels are the rear wheels of the toy car.

7. A combination of at least one toy car and a track assembly defining a path of travel for the toy car, the combination being adapted for providing at least two different forward speeds to the toy car comprising:

at least one toy car chassis;

a motor mounted within the chassis and having a rotating output shaft;

wheel means connected to the chassis body to permit movement of the toy car on the track assembly, said wheel including a pair of driving wheels interconnected by a rigid axle;

a first set of gears operatively connected to the output shaft of the motor and driven thereby;

a one-way clutch connecting the first set of gears to the axle to drive the axle and both driving wheels in a forwardly direction only as the output shaft is rotated in a first direction, in a second direction of rotation of the output shaft shaft the one-way clutch disconnecting the axle from the first set of gears;

a second set of gears operatively connected to the output shaft of the motor and driven thereby;

a second one-way clutch connecting the second set of gears to the axle to drive the axle and both driving wheels in a forwardly direction only as the output shaft is rotated in a second direction which is opposite to the first direction, in the first direction of rotation of the output shaft the second one-way clutch disconnecting the axle from the second set of gears, the first set of gears having a higher gear reduction ratio than the second set of gears whereby the entire axle and both wheels are driven at a lower speed by the first set of gears than by the second set of gears and whereby the forward speed of the toy car depends on the direction of rotation of the output shaft of the motor, and first means for changing direction of rotation of the output shaft of the motor.

8. The combination of claim 7 wherein the motor is an electric motor, and wherein the track assembly includes at least one pair of electrically conductive rail means for supplying direct current to the electric motor, and wherein the first means comprise switch means for changing polarity of the rail means.

9. The combination of claim 8 wherein the switch means are configured to simulate a gear stick shift having at least a first and a second position, the polarity of current supplied by the rail means to the motor being opposite in the second position of the stick shift than in the first position.

10. The combination of claim 9 wherein the simulated stick shift is attached to a track section which is adapted to be operatively inserted within the track assembly.

11. The combination of claim 8 wherein the toy car includes a magnet, and wherein the rail means are made of a material attracting the magnet, a magnetic force between the magnet and the rail means providing a relatively large force for keeping the toy car on the track assembly and for assisting the toy car to negotiate sharp turns at relatively high speeds.

12. The combination of claim 11 further including first electric circuit means operatively connected to the switch means for continuously changing the voltage of the current supplied to the electric motor whereby the torque output of the motor is modulated.

13. The combination of claim 12 wherein the second electric circuit means includes a resistive load which is automatically inserted in the path of the current supplied to the rail means as the polarity of the current is switched by the switch means to cause rotation of the axle through the first set of gears.

14. The combination of claim 12 wherein the first electric circuit means comprise a continuously variable resistive load which is operatively connected to the switch means and is connected in the path of the current supplied to the electric motor regardless of the positioning of the switch means, and wherein the second electric circuit means comprise a predetermined resistive load connected in series with the continuously variable resistive load as the polarity of the current is switched by the switch means to cause driving of the axle through the first set of gears, the predetermined resistive load being connected parallel with the variable resistive load as the polarity of the current is switched by the switch means to cause driving of the axle through the second set of gears.

15. The improvement of claim 7 wherein the output shaft has a pinion gear, the first set of gears comprise a first crown gear connected to the pinion gear and wherein the second set of gears comprise a second crown gear connected to the pinion gear, the first and second crown gears being disposed to rotate in parallel but opposite directions as the pinion gear rotates in either direction, the first crown gear having more teeth than the second crown gear.

16. The invention of claim 15 wherein the means for altering the polarity of the power supply includes a switch simulating an automotive gear shift lever.

17. A combination of at least one toy car and a track assembly defining a path of travel for the toy car, the combination comprising:

at least one toy car chassis;

a direct current electric motor mounted within the chassis and having a rotating output shaft;

a track assembly including at least one pair of electrically conductive rail means for supplying direct current to the electric motor, the rail means including ferromagnetic material so as to attract a magnet;

wheel means connected to the chassis body to permit movement of the toy car on the track assembly, said wheel means including a pair of wheels interconnected by an axle;

a first set of gears operatively connected to the output shaft of the motor and driven thereby;

a one-way clutch connecting the first set of gears to the axle to drive the axle as the output shaft is rotated in a first direction;

a second set of gears operatively connected to the output shaft of the motor and driven thereby;

a second one-way clutch connecting the second set of gears to the axle to drive the axle as the output shaft is rotated in a second direction which is opposite to the first direction, the first set of gears having a higher gear reduction ratio than the second set of gears whereby the entire axle and both wheels are rotated at a lower speed by the first set of gears than by the second set of gears and whereby the speed of the axle and wheels depends on the direction of rotation of the output shaft of the motor;

a magnet mounted within the toy car chassis for operative interaction with the rail means whereby a magnetic force attracts the toy car chassis to the track assembly, and switch means operatively connected to the rail means for changing polarity of the direct current supplied by the rail means to the electric motor whereby direction of rotation of the output shaft of the electric motor is reversed at the option of a player, the switch means including first electric circuit means for continuously changing, at the option of the player, the voltage of the current supplied to the electric motor whereby the torque output of the electric motor is modulated, the switch means further including second electric circuit means for automatically lowering voltage of the current supplied to the electric motor as the polarity of the current is switched by the switch means to cause driving of the axle through the first set of gears.

18. A miniature toy car having different forward driving gear ratios to effect the speed of the car comprising:

a car chassis body;

a direct current electric motor mounted to the car chassis body and having a rotating output shaft, the electric motor being adapted for connection to a direct current power supply;

wheel means connected to the chassis body to permit movement of the toy car on a support surface, the wheel means including a pair of wheels interconnected by an axle;

a first set of gears operatively connected to the output shaft of the motor and driven thereby;

a one-way clutch connecting the first set of gears to the axle to drive the axle as the output shaft is rotated in a first direction;

a second set of gears operatively connected to the output shaft of the motor and driven thereby;

a second one-way clutch connecting the second set of gears to the axle to drive the axle as the output shaft is rotated in a second direction which is opposite to the first direction, the first and second sets of gears having different gear ratios when driving the axle whereby the entire axle and both wheels are rotated in a different speed depending on the direction of rotation of the output shaft of the motor, and means actuable by a player operatively connected with the electric motor and adapted for operative connection to the power supply for altering polarity of the power supplied to the electric motor whereby the direction of rotation of the output shaft of the electric motor is changed, the means further including a first variable resistor for controlling the speed of the car and a second resistor which is only activated by the power supply when the polarity of the direct current power supply energizing the motor is selected to drive the set of gears having the lower gear ratio to provide a further reduction in the speed of the wheels.

* * * * *